United States Patent [19]

Steinhaus

[11] Patent Number: 4,849,026

[45] Date of Patent: Jul. 18, 1989

[54] METHOD OF AND SYSTEM FOR CLEANING AND/OR DRYING THE INNER WALLS OF PIPELINES

[75] Inventor: Ing. H. Steinhaus, Datteln, Fed. Rep. of Germany

[73] Assignee: Energietechnik, Fed. Rep. of Germany

[21] Appl. No.: 761,781

[22] Filed: Aug. 2, 1985

[30] Foreign Application Priority Data

Aug. 3, 1984 [DE] Fed. Rep. of Germany ..... 3428720

[51] Int. Cl.[4] ..... B08B 9/00

[52] U.S. Cl. ..... 134/22.12; 134/105; 134/107

[58] Field of Search ..... 134/7, 8, 9, 2, 22.11, 134/22.1, 22.12, 24, 30, 31, 105, 107

[56] References Cited

U.S. PATENT DOCUMENTS 3,084,076 4/1963 Laicks ..... 134/22.1

*Primary Examiner*—H. M. Sneed
*Assistant Examiner*—Sharon T. Cohen
*Attorney, Agent, or Firm*—Leydig, Voit, & Mayer

[57] ABSTRACT

For cleaning and/or drying the inner walls of projected pipelines the pressure in the interior of the pipeline is decreased and the vapor formed by evaporation of the substance adhering to the pipe inner wall and, if applicable, present foreign gases are exhausted from the pipeline. Upon exit from the pipeline and prior to entry into the exhausting apparatus, the exhausted medium passes through a condensating apparatus whose cooling surfaces are maintained at a temperature that is lower than the pipe wall temperature. With a temperature difference sufficient to condense the substance vapor on said cooling surfaces it was possible to considerably enhance the drying rate as compared to pure vacuum-type drying.

11 Claims, 1 Drawing Sheet

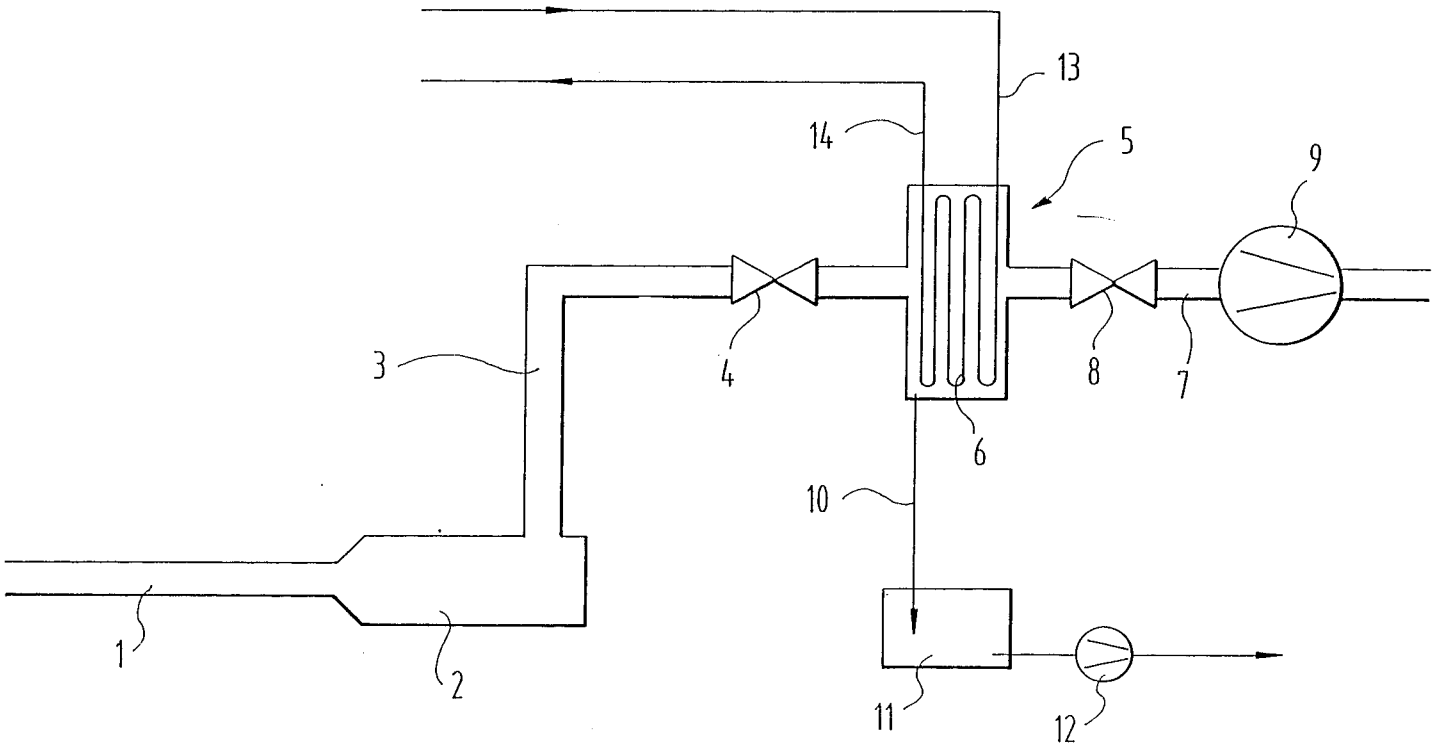
9
7
8
5
13
6
14
4
3
2
1
12
11
10

METHOD OF AND SYSTEM FOR CLEANING AND/OR DRYING THE INNER WALLS OF PIPELINES

BACKGROUND OF THE INVENTION

The invention is directed to a method of cleaning and/or drying the inner walls of projected pipelines, wherein the vapour formed by evaporation of the substance adhering to the pipe inner wall and, if applicable, present foreign gases are exhausted from the pipeline by means of one or several exhausting apparatus.

A method of this type has been known from the DE-OS No. 2,950,542. In the known method, the medium exhausted from the pipeline is directly introduced into the exhausting apparatus. The exhausting apparatus used is a system of single or multi-stage sucking jet nozzles comprising, for instance, a plurality of nozzles disposed in series so that successively higher vacuum stages can be obtained. Multi-plate vacuum pumps are mentioned as a further suitable exhausting apparatus for vacuum-type drying of pipelines. Insofar as said publication also mentions interstage condensors, experience has shown that condensors are concerned which are provided downstream of the first stage of a multi-stage vacuum plant and at which—due to the already effected partial compression—the water vapour heated to about 60° to 100° C. is condensed on cooling surfaces maintained at a temperature of from 20° to 30° C. so that the succeeding vacuum stages are protected from the effects of water vapour.

The drying rate of the known vacuum-type drying process is determined solely by the suction capacity of the vacuum system. The latter cannot be increased as desired, because with increasing vacuum also the pressure losses in the usual pipe unions provided on a pig trap will increase.

It is the object of the instant invention to considerably increase the drying rate of a vacuum-type drying method of the known type by the use of simple means.

SUMMARY OF THE INVENTION

The solution of the above object according to the invention resides in that the exhausted medium, after exit from the pipeline and prior to entry into the exhausting apparatus, passes through a condensating apparatus whose cooling surfaces are kept at a temperature that is lower than the temperature of the pipe inner wall.

In the method according to the invention, the drying rate is not determined by the suction capacity of the vacuum system but by refrigerating capacity which is provided by a refrigerant. The drying rate of such a condensation-type drying method remains constant, whereas the drying rate of a vacuum system decreases with a decrease in vapour pressure. In practical operation, the drying rate of a vacuum system, which delivered c. 4,000 $m^3$ of air/water vapour mixture per hour, could be enhanced by more than three-times this value due to an additional refrigerating capacity of 100 kW in the condensating apparatus.

Advantageous embodiments and developments of the invention will be apparent from the subclaims.

With the method according to the invention it is possible to remove from a pipeline any desired substances which evaporate at temperatures prevailing within the pipeline at technically available negative pressures namely pressures below atmospheric, and which may be condensed outside of the pipeline on the cooling surface of a condensating apparatus. One of the typical substances is especially water, which, as experience has shown, adheres to the pipe wall in a quantity of c. 100 g/$m^2$ of wall surface and has to be removed when the pipeline is dried. Further typical substances are methanol, ethanol, glycols and other hygroscopic organic liquids which will remain adhering to the pipe wall when the pipeline is cleaned by pigs and will have to be removed subsequently. For pipelines containing liquefied natural gas, there arises the problem of removing the liquid-gas film adhering to the pipe wall when cleaning is to be effected. The method according to the invention enables removal of the above-specified substances and of others which typically occur in the drying and/or cleaning of pipelines.

In the method according to the invention, the pressure in the interior of the pipeline is lowered at least to a level which corresponds to the gas pressure of the substance to be removed at the respective pipe wall temperature. Such a lowering in pressure promotes vaporization of the substance to be removed and removes non-condensable foreign gases from the pipeline which would otherwise obstruct the vapour flow. In practical use, good results have been obtained when the pressure in the interior of the pipeline was lowered to an absolute value in the range of from 1 to 40 mbar. Preferably, a pressure between 3 and 13 mbar is set for the interior of pipelines projected in northern terrain, which have an average pipe wall temperature of about 6° C. For pipelines running through tropical terrain such as Australia or the South China Sea, whose pipe temperature may be as much as 11° C. and more, a pressure between 10 and 30 mbar is preferably set in the pipeline interior.

In order to ensure the provided under atmospheric pressure at the specified absolute levels inside the pipeline, an exhausting apparatus of sufficient capacity must be provided. As such pipelines may be as long as 200 km and more, a pressure gradient will naturally develop which depends on the length and the diameter of the pipeline.

The cooling surfaces of the condensating apparatus are maintained at a temperature that is lower than the pipe wall temperature. In practical use, good results will be obtained already at relatively small temperature differences of about 4° to 5° C. For the removal of water (drying) it is possible, for instance, to maintain the cooling surface temperature at about 0° C. so that the condensed water will be obtained in liquid form and may be drained. According to an alternative embodiment the cooling surfaces may be maintained at such a low temperature that the substance to be removed is deposited on said cooling surfaces in solid state. In this case it is preferred to provide a plurality of condensating apparatus of the regenerative type. The exhausted medium may alternatingly be supplied to a group of condensating apparatus, where the substance is deposited. In the meantime, another group of condensating apparatus not in use at the time is raised to a higher temperature so as to remove the deposited substance. A third group of condensating apparatus may be available for other tasks. For example, two condensating apparatus of the regenerative type may be provided, wherein the exhausted medium is alternatingly supplied to one or the other condensating apparatus and the substance is deposited. In the meantime, the respective condensating apparatus not in use is raised to a higher temperature so as to remove the deposited substance.

Good results have been achieved, for example, with a refrigerating machine having a capacity of 100 kW and having its cooling surfaces cooled by means of air or a brine flow of water/glycol.

In particular for long pipelines it has proven expedient to exhaust the medium formed of substance vapour and foreign gases at least from either end of the pipeline, to condense the vapour in the condensating apparatus, and to remove the non-condensable foreign gases via the vacuum system. For very long pipelines having a length of more than 100 km, medium may additionally be exhausted and similarly treated at further locations such as the valve stations. At each exhausting location two or more condensating apparatus may be provided which are operated alternatingly. It is thereby possible to achieve a considerably greater reduction of the time required for complete drying than would be possible by a corresponding enhancement of the capacity of the apparatus. Below, a preferred embodiment of the invention will be explained in detail with reference to a drawing; the latter is a schematic view of the circuit and the configuration of the system according to the invention.

BRIEF DESCRIPTION OF THE DRAWING

The FIGURE is a schematic view an apparatus embodying the invention.

DESCRIPTION OF THE PREFERRED EMBODIMENT

The pipe wall of the pipeline 1, to which residual water adheres, has the mean ground temperature $T_1$. The pipeline section shown terminates in a pig trap 2. A first connecting conduit 3 communicates said pig trap 2 to the condensating apparatus 5. This first connecting conduit 3 may be blocked by means of a check valve 4. A second connecting conduit 7 communicates the condensating apparatus 5 to the exhausting means 9 which may, for example, be an exhauster or a vacuum apparatus. The second connecting conduit 7 may be blocked by means of a second check value 8. The cooling surfaces 6 in the interior of the condensating apparatus 5 are maintained at a temperature $T_2$, which is lower than the temperature $T_1$, to which end refrigerant may be supplied through the refrigerant conduit 13 to the condensating apparatus 5 and discharged through the refrigerant conduit 14.

Upon operation of the exhausting means 9 and opening of the check valves 8 nd 4, the water vapour/air mixture is exhausted from the pipeline 1, passes over the cooling surfaces 6 in the condensating apparatus 5 and thereupon reaches the exhausting means 9. Water in liquid state is separated on the cooling surfaces 6 and flows through a third connecting conduit 10 into a condensate collector 11. From this condensate collector 11 the condensate may be withdrawn from time to time by means of a condensate pump 12.

The following illustrative results were achieved with a system of the described structure:

EXAMPLE 1 pipe wall temperature: 11° C.
water vapour pressure inside pipeline: 13.12 mbar
refrigerating capacity of condensating apparatus: 100 kW
drying rate: 145 kg of water/h
exhausted vapour volume: 14,520 $m^3/h$

EXAMPLE 2 pipe wall temperature: 6° C.
water vapour pressure inside pipeline: 9.347 mbar
refrigerating capacity of condensating apparatus: 100 kW
drying rate: 145 kg of water/h
exhausted vapour volume: 20,018 $m^3/h$

I claim:

1. A method of removing a substance from the inner walls of projected pipelines comprising forming a vapor by evaporating the substance from the pipe inner wall, exhausting the medium within the pipeline by means of at least one exhausting apparatus, and, after exit from the pipeline and prior to entry into the exhausting apparatus, passing the medium through a condensating apparatus whose cooling surfaces are maintained at a temperature that is lower than the temperature of the pipe wall.

2. The method of claim 1 wherein forming the vapor includes lowering the pressure in the interior of the pipeline at least to a level which corresponds to the vapor pressure of the substance to be removed at the respective pipe wall temperature.

3. The method of claim 2 wherein the pressure is lowered to a value in the range from about 1 to about 40 mbar.

4. The method of claim 2 further comprising maintaining the cooling surfaces at a sufficiently low temperature to deposit the vapor of the substance in a liquid state.

5. The method of claim 4 wherein the substance being removed is water and the cooling surfaces are maintained at a temperature of about 0 degrees Centigrade.

6. The method of claim 2 wherein the medium is exhausted at either end of the pipeline.

7. The method of claim 6 wherein the medium is additionally exhausted at at least one location intermediate the ends of the pipeline.

8. The method of claim 2 further comprising maintaining the cooling surfaces at a sufficiently low temperature to deposit the vapor of the substance on the cooling surfaces in a solid state.

9. The method of claim 1 further comprising maintaining the cooling surfaces at a sufficiently low temperature to deposit the vapor of the substance in a liquid state.

10. The method of claim 9 wherein the substance being removed is water and the cooling surfaces are maintained at a temperature of about 0 degrees Centigrade.

11. The method of claim 1 further comprising maintaining the cooling surfaces at a sufficiently low temperature to deposit the vapor of the substance on said cooling surfaces in a solid state.

* * * * *